United States Patent [19]

Shanebrook

[11] 4,132,875

[45] Jan. 2, 1979

[54] YARN DETECTOR SWITCH WITH SNAP-ON TRAPPER

[75] Inventor: Robert E. Shanebrook, Boothwyn, Pa.

[73] Assignee: Cutler-Hammer, Inc., Milwaukee, Wis.

[21] Appl. No.: 834,818

[22] Filed: Sep. 19, 1977

[51] Int. Cl.[2] ..... B65H 25/14

[52] U.S. Cl. ..... 200/61.13; 28/227; 57/81; 66/163; 200/61.18

[58] Field of Search ..... 57/81, 107; 200/61.13, 200/61.18; 66/157, 163, 161; 28/185–189, 227

[56] References Cited

U.S. PATENT DOCUMENTS

| | | | |
|---|---|---|---|
| 2,706,883 | 4/1955 | Keen | 57/107 X |
| 3,848,434 | 11/1974 | Hopkins | 28/187 X |
| 4,027,121 | 5/1977 | Haderer et al. | 200/61.13 |

*Primary Examiner*—James R. Scott

*Attorney, Agent, or Firm*—Hugh R. Rather; William A. Autio; Michael E. Taken

[57] ABSTRACT

A two-piece snap-on yarn trapper including a molded U-shaped bracket that snaps onto a yarn detector switch and supports a plural-turn helical spring. This spring is held inwardly bowed in the bracket so that the turns are held open or separated on the yarn side to provide a series of V-grooves for receiving the yarn that is drawn tightly thereinto by the trip lever of the yarn detector switch thereby to trap the yarn when it goes slack. The bracket is provided with a pair of inner edges or guides to guide the yarn to the middle portion of the helix where trapping is most effective and reliable. The helical spring is compressed and snap-in assembled on a pair of angularly-disposed stubs received in opposite ends thereof to hold the spring in its bowed condition on the bracket due to the tension of the helix.

8 Claims, 4 Drawing Figures

YARN DETECTOR SWITCH WITH SNAP-ON TRAPPER

BACKGROUND OF THE INVENTION

Yarn trappers for use with lower yarn detector switches have been known heretofore. For example, E. G. Haderer et al. U.S. Pat. No. 4,027,121, dated May 31, 1977, owned by the assignee of this invention, shows a yarn trapper for a yarn detector switch having a two-turn wire helix with the ends of the wire bent to diverge laterally to form a V-shaped guide for the yarn and then bent parallel to one another and the extreme tips being bent toward one another for snap-on mounting on the yarn detector switch.

While such prior known yarn trapper has been useful for its intended purpose, it has not performed 100 percent of the time because the yarn must enter between a full turn and a half turn. That is, this two-turn helix has a full turn at the center and a half turn at each end with the half turns being above and below, respectively, of the level of the supporting arms to form two arcuate slots, one of which will not receive the yarn as fully as the other thereby to cause occasionally failure to trap the yarn.

W. R. Keen U.S. Pat. No. 2,706,883, dated Apr. 26, 1955, shows a thread trapping means having an arm adjustably mounted on a horizontal rod by a set screw. Rigidly secured to this arm is a wing-like component having a horizontal elongated slot. Pivoted on such arm is a thread-contacting trip finger that is counterweighted to swing this finger when the thread breaks. On the counterweight is a lateral projection. With its ends anchored in such lateral projection on the counterweight is a downwardlybowed closely-wound elongate coil segment which may be of spring wire or other suitable stiff strand material, and which is capable of entering with clearance all around it, into the straight elongate slot of the laterally-projecting portion of the fixed wing-like component. Since the thread normally extends between the coil and the slot, tripping the finger will allow the counterweight to fall and cause the coil to press the thread across the slot to trap it between the turns of the coil.

While the latter thread trapper appears to be useful for its intended purpose, it nevertheless is rather complex in structure and non-economical and difficult to manufacture and assemble.

This invention relates to improvements thereover.

SUMMARY OF THE INVENTION

An object of the invention is to provide an improved yarn trapper for use with a yarn detector switch.

A more specific object of the invention is to provide an improved yarn trapper that is more reliable and effective in performing its function.

Another specific object of the invention is to provide an improved yarn trapper that is easy and economical to manufacture and assemble.

Another specific object of the invention is to provide an improved yarn trapper design wherein the V-grooves formed by the entrapped spring are consistently repeatable and controllable in a simple and economical manner.

Another specific object of the invention is to provide an improved yarn trapper having means guiding and confining the yarn to the center portion of a multiple-turn, bowed helix where trapping is most effective and reliable.

Other objects and advantages of the invention will hereinafter appear.

DESCRIPTION OF THE PREFERRED EMBODIMENT

Figure 1:
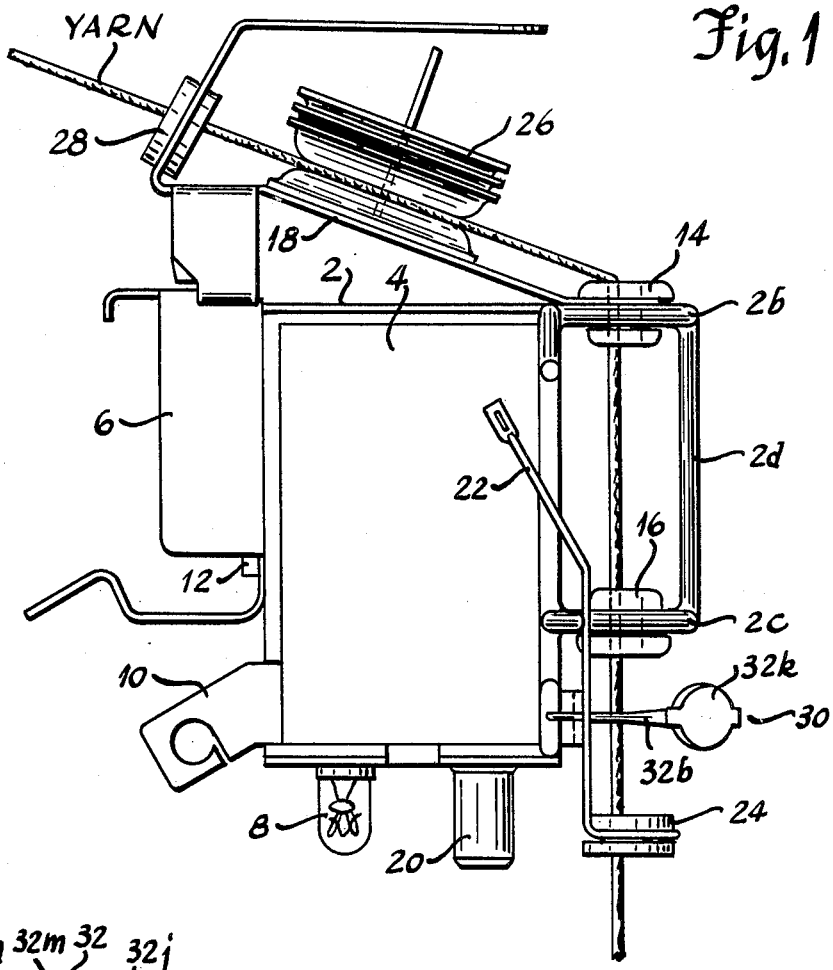
FIG. 1 shows a front elevational view of a lower yarn detector switch in its normal untripped condition and the yarn trapper mounted thereon.

Referring to FIG. 1, there is shown a "lower" yarn detector switch generally similar to that disclosed in the aforementioned E. G. Haderer et al patent and described in more detail therein, except for the yarn trapper mounted thereon. "Lower" refers to the fact that this switch is positioned near the point where the yarn enters the knitting elements of the machine. Thus, this switch, upon tripping in the event the yarn breaks, is able to stop the machine before the end of the broken yarn is drawn into and enters the knitting needles.

In the textile industry, on knitting machinery, a trapper is usually furnished with the lower yarn detector switch. When knitting certain patterns, such as stripes on striper machines, certain yarns will not be fed during portions of the knitting of the particular pattern and, therefore, these yarns have a tendency to go slightly slack until they are drawn up again. As a yarn goes slack, the trapper functions to catch and hole the yarn, keeping it taught in the detector switch area, and thus preventing the switch from tripping the machine off. If the trapper does not function properly, it will allow unwanted stoppage of the machine. It is therefore desirable to provide an efficient and reliable yarn trapper to reduce the machine down-time to a minimum.

As shown in FIG. 1, the lower yarn detector switch is provided with an insulating housing 2, including a front cover 4 that is snapped in place to close the front of the housing and enclose the trip mechanism therein. A mounting bracket 6 is secured to the left side of the housing for snap-in mounting of the switch to a horizontally running metal strip or bar, such mounting bracket or clip also serving as one terminal, negative or ground, of the electric circuit therein. This electric circuit extends from its negative terminal or ground at mounting bracket 6 through the trip mechanism contacts in the housing the lamp bulb 8 to its positive terminal at lamp terminal plate 10. Housing 2 is provided with suitable means 12 for securing mounting bracket 6 thereto as described in the aforementioned E. G. Haderer et al. patent.

Housing 2 is also provided with stationary yarn guiding means including integrally-molded upper and lower, parallel eyelet supports **2*b* and 2*c* extending laterally from the right wall thereof and connected by an integral vertical bar 2*d* for rigidity. These supports are provided with means for snap-in mounting of ceramic eyelets 14 and 16, respectively. Upper eyelet 14 secures the divided end of a yarn tension bracket 18** as hereinafter described.

The detector switch has a rotatable adjusting member 20 that extends down through a hole in the lower wall of the housing to be accessible for manual adjustment of the spring tension of the trip mechanism within the housing.

Trip lever 22 is a generally U-shaped wire member having its end slotted for snap-in coupling with the external ends of a crank that extends out through the front cover and rear wall of the housing. This coupling holds the trip lever rigidly to the crank shaft so that the trip lever, upon being released by the yarn, will allow the tension spring to rotate the crank shaft to close the switch contacts when the yarn breaks. The lower portion of the trip lever is vertically disposed as shown in FIG. 1 and its lower end is bent at a right angle toward the right and formed to retain a ceramic eyelet 24, this eyelet being in vertical alignment with eyelets 14 and 16 in operative position of the trip lever as shown in FIG. 1.

Yarn tension bracket 18 is secured to eyelet 14 and mounting bracket 6. This yarn tension bracket is formed to retain a stack of tension-producing or drag washers 26 between which the yarn runs and a ceramic eyelet 28 through which the yarn passes toward washers 26 and then to yarn guiding eyelet 14.

Figure 3:
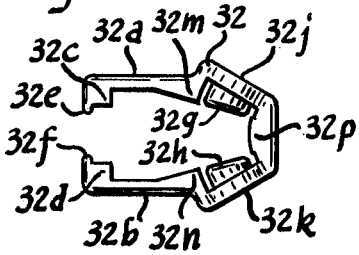
FIG. 3 is a top view of the yarn trapper supporting bracket with the helix removed to show its angular retaining stubs.
Figure 2:
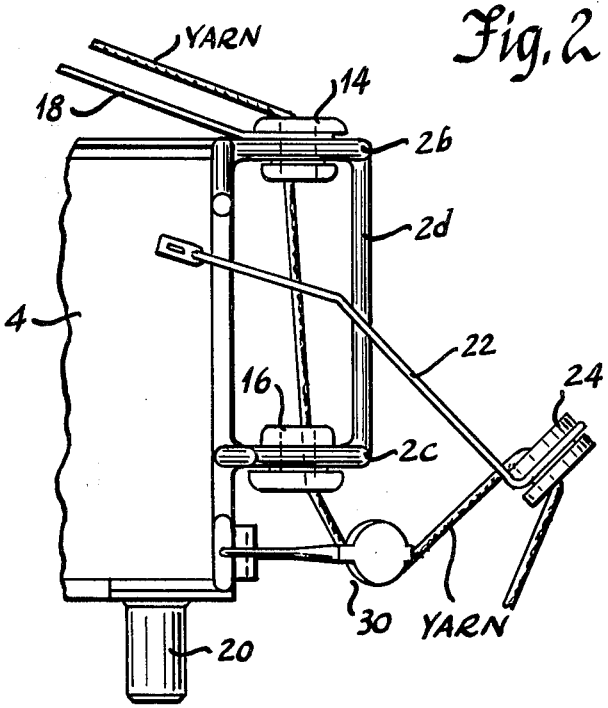
FIG. 2 is a fragmentary front elevational view of the lower yarn detector switch of FIG. 1 showing a slack yarn trapped to prevent tripping of the switch.
Figure 4:
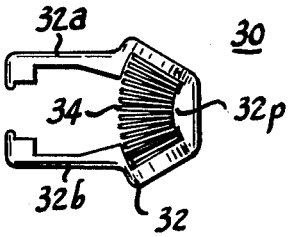
FIG. 4 is a top view of the yarn trapper showing the helix assembled on the supporting bracket between the angular abutments.

The yarn detector switch is provided with the aforementioned improved yarn trapper 30 that is snap-in mounted to the lower right-hand portion of the switch housing below eyelet 16. As shown in FIGS. 3 and 4, this yarn trapper has two parts, a bracket 32 and a helical spring 34 held inwardly bowed on the bracket. Bracket 32 is made of molded plastic such as "nylon" or the like and is provided with a pair of arms **32*a* and 32*b* generally parallel to one another. The ends of these arms have integral flat portions 32*c* and 32*d* extending toward one another. Short projections or nibs 32*e* and 32*f* on the tips of these flat portions also extend toward one another. To mount this bracket on the yarn detector switch, these arms are slightly spread apart and projections 32*e–f* are then allowed to snap into holes on opposite sides on the switch housing while flat portions 32*c–d* enter grooves extending horizontally toward the right from such holes thereby to hold the trapper horizontally disposed as shown in FIGS. 1 and 2**. These holes and grooves on the lower right-hand portion of the switch housing are more clearly shown in the aforementioned Haderer et al. U.S. Pat. No. 4,027,121.

This bracket is also provided with means for holding wire helix 34 in a suitably bowed condition thereon so that the turns are spread apart on the yarn side thereof so as to most effectively tip the yarn when it is drawn thereinto by trip lever 22. For this purpose, this mounting bracket is provided with a pair of short spring-retention stubs **32*g* and 32*h* that extend from the centers of enlarged, generally circular abutments 32*j* and 32*k*, respectively, as shown in FIGS. 1 and 3. These abutments are disposed at angles of about 30 degrees on opposite sides of a vertical center plane and the stubs extend toward one another at similar 30 degree angles from a vertical lateral plane so that when the coil spring is snapped therebetween, the right side (outside) of the turns will be compressed together and the left side (inside) of the turns will be held separated to provide trapping slots for the yarn. When so assembled, the stubs extend into the opposite ends of the spring and the opposite ends of the spring bear against the abutments to retain the spring securely in place on the bracket. Also, the inner edges of arms 32*a* and 32*b* are provided with converging portions 32*m* and 32*n* extending from about the middle of these arms toward the inner ends of stubs 32*g* and 32*h***. These converging portions guide the yarn toward the central turns of the helix where the separations between the turns are substantially uniform and of the optimum width to effectively trap the yarn and also conceal the end turns of the helix from access by the yarn where the retention would not be as reliable.

This bracket 32 is further provided with an arcuate abutment **32*p* that abuts the compressed together side of the turns of the helix to assist in retaining it in its bowed condition as shown in FIG. 4**.

It will be apparent from the foregoing that the trapper structure hereinbefore described is simple and economical to manufacture and assemble. The bracket may be molded and the spring may be cut to the proper length and snapped in place. It also provides V-grooves that are consistently repeatable and controllable without the requirement of close repeatable and controllable without the requirement of close tolerance manufacture of parts.

When the yarn becomes slightly slack but not so much as to require stopping of the machine, lever 22 swings out as shown in FIG. 2 and draws the yarn between the open turns of trapper helix 34. The yarn being thus trapped, the swing of trip lever 22 is limited to less than that which would cause tripping of the detector switch. When the yarn is again drawn into the knitting machine, trip lever 22 will be restored to the condition shown in FIG. 1.

While the apparatus hereinbefore described is effectively adapted to fulfill the objects stated, it is to be understood that the invention is not intended to be confined to the particular preferred embodiment of Snap-On Yarn Trapper disclosed, inasmuch as it is susceptible of various modifications without departing from the scope of the appended claims.

I claim:

1. In a yarn detector device having a housing including yarn guiding means, a detector mechanism in the housing including a spring-biased trip switch, a trip lever on the outside of the housing coupled to the trip switch and biased by the latter into one pivotal direction tending to operate the switch and having an eyelet through which the yarn passes and when taut holds the trip lever in its opposite pivotal direction maintaining the switch inoperative, the improvement comprising:

a yarn trapper mounted on the housing and comprising:

a multiple-turn helix;

a supporting bracket having a portion retaining said helix in bowed condition wherein the turns at one side are compressed more than at the other side where they are spaced apart to provide a plurality of V-grooves forming traps for the yarn;

said supporting bracket comprising a pair of spaced-apart arms extending from said helix-retaining portion thereof on opposite sides of the yarn to confine the yarn therebetween as the yarn approaches the eyelet of said trip lever;

snap-in means mounting the ends of said arms to the detector housing to confine the yarn between said housing, said arms and the corresponding spaced-apart turns of said helix that provide said traps to catch the yarn upon partial swinging of the trip lever due to slackness in the yarn thereby to prevent unwanted tripping;

said retaining portion comprising angularly-disposed means on said bracket retaining the opposite ends of said helix to hold it in its bowed condition;

and converging inner sides on said arms for guiding the yarn toward the midportion of the helix where the separations between the turns are substantially uniform and most effective for trapping the yarn when it is drawn thereinto by partial swinging of the trip lever.

2. The yarn trapper claimed in claim 1, wherein:

said angularly-disposed means is at one end of said supporting bracket and is provided with angularly disposed stubs and a pair of abutments similarly angularly disposed;

and said helix is compressed between said abutments with said stubs extending into opposite ends thereof.

3. The yarn trapper claimed in claim 1, wherein:

said helix is made of metal wire and has a free length longer than the distance between said abutments thereby to retain said helix bowed when it is snap-in inserted between said abutments.

4. The yarn trapper claimed in claim 1, wherein:

said supporting bracket is molded of plastic material as a one-piece unit.

5. The yarn trapper claimed in claim 1, wherein said snap-in means mounting the ends of said arms to the detector housing comprise:

nibs on the ends of said arms and corresponding holes in said housing whereby said arms may be flexed and allowed to snap in said holes to mount the bracket to the detector housing.

6. The yarn trapper claimed in claim 5, wherein said snap-in means mounting the ends of said arms to the detector housing also comprises:

lateral portions on said arms immediately adjacent said nibs and corresponding grooves in said housing for retaining said lateral portions to support said bracket in a horizontal disposition with respect to said housing.

7. The yarn trapper claimed in claim 6, wherein:

said nibs and said lateral portions on said two arms are directed toward one another and said holes and grooves extend in from opposite walls of the detector housing so that said arms may be spread apart and allowed to snap into place on the housing.

8. The yarn trapper claimed in claim 1, wherein:

said supporting bracket also comprises an arcuate abutment engaging the more-compressed side of said helix to assist in retaining it in its bowed condition and to support it when the yarn is drawn between the turns.

* * * * *